US011475901B2

(12) United States Patent
Faure et al.

(10) Patent No.: US 11,475,901 B2
(45) Date of Patent: *Oct. 18, 2022

(54) FRAME LOSS MANAGEMENT IN AN FD/LPD TRANSITION CONTEXT

(71) Applicant: ORANGE, Paris (FR)

(72) Inventors: Julien Faure, Ploubezre (FR); Stephane Ragot, Lannion (FR)

(73) Assignee: ORANGE, Paris (FR)

( * ) Notice: Subject to any disclaimer, the term of this patent is extended or adjusted under 35 U.S.C. 154(b) by 303 days.

This patent is subject to a terminal disclaimer.

(21) Appl. No.: 16/782,539

(22) Filed: Feb. 5, 2020

(65) Prior Publication Data

US 2020/0175995 A1 Jun. 4, 2020

Related U.S. Application Data

(63) Continuation of application No. 15/329,428, filed as application No. PCT/FR2015/052075 on Jul. 27, 2015, now Pat. No. 10,600,424.

(30) Foreign Application Priority Data

Jul. 29, 2014 (FR) ..... 14 57356

(51) Int. Cl.
*G10L 19/005* (2013.01)
*G10L 19/022* (2013.01)
*G10L 19/20* (2013.01)

(52) U.S. Cl.
CPC ..... *G10L 19/005* (2013.01); *G10L 19/022* (2013.01); *G10L 19/20* (2013.01)

(58) Field of Classification Search
CPC ..... G10L 19/005; G10L 19/022; G10L 19/12; G10L 19/20
See application file for complete search history.

(56) References Cited

U.S. PATENT DOCUMENTS 4,969,193 A * 11/1990 Scott ..... G10L 19/00 704/203
6,952,668 B1 10/2005 Kapilow
(Continued)

FOREIGN PATENT DOCUMENTS

BR PI0718300 A2 * 1/2014
CN 103187066 A 7/2013
(Continued)

OTHER PUBLICATIONS

A. V. McCree and T. P. Barnwell, "A mixed excitation LPC vocoder model for low bit rate speech coding," in IEEE Transactions on Speech and Audio Processing, vol. 3, No. 4, pp. 242-250, Jul. 1995, doi: 10.1109/89.397089. (Year: 1995).*
(Continued)

*Primary Examiner* — Daniel C Washburn
*Assistant Examiner* — Oluwadamilola M Ogunbiyi
(74) *Attorney, Agent, or Firm* — Faegre Drinker Biddle & Reath LLP

(57) ABSTRACT

A method for decoding a digital signal encoded using predictive coding and transform coding, comprising the following steps: predictive decoding of a preceding frame of the digital signal, encoded by a set of predictive coding parameters; detecting the loss of a current frame of the encoded digital signal; generating by prediction, from at least one predictive coding parameter encoding the preceding frame, a frame for replacing the current frame; generating by prediction, from at least one predictive coding parameter encoding the preceding frame, an additional segment of digital signal; temporarily storing said additional segment of digital signal.

7 Claims, 4 Drawing Sheets

(56) References Cited

U.S. PATENT DOCUMENTS

| | | | | |
|---|---|---|---|---|
| 8,374,853 | B2 | 2/2013 | Ragot et al. | |
| 8,527,265 | B2 | 9/2013 | Reznik et al. | |
| 9,047,859 | B2 * | 6/2015 | Ravelli | G10L 19/12 704/223 |
| 2001/0007575 | A1 * | 7/2001 | Mori | H04N 19/174 375/E7.137 |
| 2002/0007273 | A1 | 1/2002 | Chen | |
| 2002/0123884 | A1 | 9/2002 | Lin et al. | |
| 2003/0133504 | A1 * | 7/2003 | Hanami | G06T 1/20 375/240.26 |
| 2004/0181405 | A1 | 9/2004 | Shlomot et al. | |
| 2004/0199276 | A1 * | 10/2004 | Poon | G11B 27/30 |
| 2006/0008012 | A1 * | 1/2006 | Nagai | H04N 19/20 375/E7.076 |
| 2006/0146830 | A1 | 7/2006 | Lin et al. | |
| 2006/0206334 | A1 | 9/2006 | Kapoor et al. | |
| 2008/0215340 | A1 | 9/2008 | Su et al. | |
| 2009/0228290 | A1 | 9/2009 | Chen et al. | |
| 2009/0234645 | A1 | 9/2009 | Bruhn | |
| 2009/0326931 | A1 | 12/2009 | Ragot et al. | |
| 2010/0217607 | A1 * | 8/2010 | Neuendorf | G10L 19/20 704/500 |
| 2010/0306625 | A1 | 12/2010 | Kovesi et al. | |
| 2011/0044323 | A1 | 2/2011 | Zhan et al. | |
| 2011/0046761 | A1 * | 2/2011 | Titchener | G11B 20/10527 700/94 |
| 2011/0112829 | A1 | 5/2011 | Lee et al. | |
| 2011/0161087 | A1 | 6/2011 | Ashley et al. | |
| 2011/0173008 | A1 | 7/2011 | Lecomte et al. | |
| 2011/0218799 | A1 | 9/2011 | Mittal et al. | |
| 2011/0320212 | A1 | 12/2011 | Tsujino et al. | |
| 2012/0022881 | A1 * | 1/2012 | Geiger | G10L 19/022 704/503 |
| 2012/0087231 | A1 | 4/2012 | Zhang et al. | |
| 2013/0173259 | A1 | 7/2013 | Mittal et al. | |
| 2013/0289981 | A1 | 10/2013 | Ragot et al. | |
| 2014/0019142 | A1 | 1/2014 | Mittal et al. | |
| 2014/0088973 | A1 | 3/2014 | Gibbs et al. | |
| 2014/0112394 | A1 * | 4/2014 | Sullivan | H04N 19/88 375/240.26 |
| 2015/0195526 | A1 * | 7/2015 | Zhu | H04N 19/51 375/240.14 |
| 2015/0264357 | A1 * | 9/2015 | Alfonso | H04N 19/176 375/240.13 |
| 2017/0034026 | A1 * | 2/2017 | Li | H04L 43/16 |
| 2017/0133026 | A1 | 5/2017 | Ravelli et al. | |
| 2018/0268825 | A1 | 9/2018 | Schnabel et al. | |
| 2018/0308495 | A1 | 10/2018 | Schnabel et al. | |
| 2020/0327896 | A1 * | 10/2020 | Doehla | G10L 19/06 |
| 2022/0030271 | A1 * | 1/2022 | Li | H04N 19/147 |

FOREIGN PATENT DOCUMENTS

| | | | |
|---|---|---|---|
| JP | 2004-102074 | A | 4/2004 |
| JP | 2010-503881 | A | 2/2010 |
| JP | 2013-250582 | A | 12/2013 |
| JP | 2014-505272 | A | 2/2014 |
| WO | 2011/048117 | A1 | 4/2011 |
| WO | 2012/085451 | A1 | 6/2012 |

OTHER PUBLICATIONS

Hou, Huan, and Weibei Dou. "Real-time audio error concealment method based on sinusoidal model." 2008 International Conference on Audio, Language and Image Processing, IEEE. (Year: 2008).*

Bessette, Bruno, Roch Lefebvre, and Redwan Salami. "Universal speech/audio coding using hybrid ACELP/TCX techniques." Proceedings.(ICASSP'05). IEEE International Conference on Acoustics, Speech, and Signal Processing, 2005.. Vol. 3. IEEE. (Year: 2005).*

Neuendorf, Max, et al. "Unified speech and audio coding scheme for high quality at low bitrates." 2009 IEEE International Conference on Acoustics, Speech and Signal Processing. IEEE. (Year: 2009).*

Saleem, Yasir, Faisal Hayat, and Arslan Iqbal. "Linear Predictive Coding for Speech Compression." Mehran University Research Journal of Engineering & Technology 33.2. (Year: 2014).*

International Telecommunication Union, "General Aspects of Digital Transmission Systems, Terminal Equipments, Pulse Code Modulation (PCM) of Voice Frequencies," ITU-T Telecommunication Standardization Sector of ITU, ITU-T Recommendation G.711 (Extract from the Blue Book), 1993, 12 pages.

International Telecommunication Union, "Series G: Transmission Systems and Media, Digital Systems and Networks,Digital terminal equipments—Coding of voice and audio signals, Frame Error robust narrow-band and wideband embedded variable bit-rate coding of speech and audio from 8-32 kbits/s," ITU-T Telecommunication Standardization Sector of ITU, ITU-T Recommendation G.718, Jun. 2008, 257 pages.

International Telecommunication Union, "Series G: Transmission Systems and Media, Digital Systems and Networks, Digital terminal equipments—Coding of analogue signals, Low-complexity, full-band audio coding for high-quality, conversational applications," ITU-T Telecommunication Standardization Sector of ITU, ITU-T Recommendation G.719, Jun. 2008, 57 pages.

International Telecommunication Union, "Series G: Transmission Systems and Media, Digital Systems and Networks, Digital terminal equipments—Coding of analogue signals by methods other than PCM, Low-complexity coding at 24 and 32 kbit/s for hands-free operation in systems with low frame loss," ITU-T Telecommunication Standardization Sector of ITU, ITU-T Recommendation G.722.1, May 2005, 34 pages.

International Telecommunication Union, "Series G: Transmission Systems and Media, Digital Systems and Networks, Digital terminal equipments—Coding of analogue signals by methods other than PCM, Wideband coding of speech at around 16 kbit/s using Adaptive Multi-Rate Wideband (AMR-WB)," ITU-T Telecommunication Standardization Sector of ITU, ITU-T Recommendation G.722.2, Jul. 2003, 71 pages.

Lecomte et al., "Efficient cross-fade windows for transitions between LPC-based and non-LPC based audio coding," Audio Engineering Society, Convention Paper 7712, AES 126th Convention, May 7-10, 2009, Munich, Germany, pp. 1-9.

Neuendorf et al., "A Novel Scheme for Low Bitrate Unified Speech and Audio Coding—MPEG RM0," Audio Engineering Society, Convention Paper 7713, AES 126th Convention, May 7-10, 2009, Munich, Germany, pp. 1-13.

Office Action issued in related application JP 2017-504685, dated Mar. 25, 2019, with English language translation, 7 pages.

Office Action issued in related application CN 201580041610.9, dated Apr. 1, 2020, with machine generated English anguage translation, 20 pages.

Office Action issued in related application CN 201580041610.9, dated Oct. 23, 2020, with machine generated English anguage translation, 33 pages.

* cited by examiner

FRAME LOSS MANAGEMENT IN AN FD/LPD TRANSITION CONTEXT

CROSS-REFERENCE TO RELATED APPLICATIONS

This application is a continuation of U.S. patent application Ser. No. 15/329,428, filed Jan. 26, 2017, which is the U.S. national phase of the International Patent Application No. PCT/FR2015/052075 filed Jul. 27, 2015, which claims the benefit of French Application No. 14 57356 filed Jul. 29, 2014, the contents being incorporated herein by reference.

BACKGROUND

The present disclosure relates to the field of encoding/decoding digital signals, in particular for frame loss correction.

The disclosure advantageously applies to the encoding/decoding of sounds that may contain alternating or combined speech and music.

To code low bit-rate speech effectively, CELP ("Code Excited Linear Prediction") techniques are recommended. To code music effectively, transform coding techniques are recommended.

CELP encoders are predictive coders. Their aim is to model speech production using various elements: short-term linear prediction to model the vocal tract, long-term prediction to model the vibration of vocal cords during voiced periods, and an excitation derived from a fixed codebook (white noise, algebraic excitation) to represent "innovation" that could not be modeled.

Transform coders such as MPEG AAC, AAC-LD, AAC-ELD or ITU-T G.722.1 Annex C use critically sampled transforms to compress the signal in the transform domain. The term "critically sampled transform" is used to refer to a transform for which the number of coefficients in the transform domain equals the number of time domain samples in each analyzed frame.

One solution for effective coding of a signal containing combined speech/music is to select the best technique over time between at least two coding modes: one of the CELP type, the other of the transform type.

This is the case for example for the codecs 3GPP AMR-WB+ and MPEG USAC ("Unified Speech Audio Coding"). The target applications for AMR-WB+ and USAC are not conversation but correspond to distribution and storage services, without severe constraints on the algorithmic delay.

The initial version of the USAC codec, called RM0 (Reference Model 0), is described in the article by M. Neuendorf et al, A Novel Scheme for Low Bitrate Unified Speech and Audio Coding—MPEG RM0, 7-10 May 2009, 126th AES Convention. This RM0 codec alternates between multiple coding modes:

- For speech signals: LPD ("Linear Predictive Domain") modes comprising two different modes derived from AMR-WB+ coding:
  - an ACELP mode
  - a TCX ("Transform Coded Excitation") mode called wLPT ("weighted Linear Predictive Transform"), using an MDCT transform (unlike the AMR-WB+ codec) which uses a FFT transform.
- For music signals: FD ("Frequency Domain") mode using coding by MDCT ("Modified Discrete Cosine Transform") of type MPEG AAC ("Advanced Audio Coding") using 1024 samples.

In the USAC codec, the transitions between LPD and FD modes are crucial to ensuring sufficient quality with no errors in switching between modes, knowing that each mode (ACELP, TCX, FD) has a specific "signature" (in terms of artifacts) and that the FD and LPD modes are of different types—FD mode is based on transform coding in the signal domain, while LPD modes use linear predictive coding in the perceptually weighted domain with filter memories to be properly managed. Management of the switching between modes in the USAC RM0 codec is detailed in the article by J. Lecomte et al., "Efficient cross fade windows for transitions between LPC-based and non-LPC based audio coding", 7-10 May 2009, 126th AES Convention. As explained in that article, the main difficulty lies in the transitions from LPD to FD modes and vice versa. We only discuss here the case of transitions from ACELP to FD.

To properly understand its function, we review the principle of MDCT transform coding using a typical example of its implementation.

In the encoder, an MDCT transformation is typically divided into three steps, the signal being subdivided into frames of M samples before MDCT coding:

- Weighting the signal by a window referred to here as an "MDCT window" of length 2M;
- Folding in the time domain ("time-domain aliasing") to form a block of length M;
- DCT ("Discrete Cosine Transform") transformation of length M.

The MDCT window is divided into four adjacent portions of equal lengths M/2, here called "quarters".

The signal is multiplied by the analysis window, then the time-domain aliasing is carried out: the first quarter (windowed) is folded (in other words time-reversed and overlapped) over the second quarter and the fourth quarter is folded over the third.

More specifically, the time-domain aliasing of one quarter over another is done in the following manner: the first sample of the first quarter is added (or subtracted) to (from) the last sample of the second quarter, the second sample of the first quarter is added (or subtracted) to (from) the next-to-last sample of the second quarter, and so on, until the last sample of the first quarter which is added (or subtracted) to (from) the first sample of the second quarter.

From four quarters we thus obtain two lapped quarters where each sample is the result of a linear combination of two samples of the signal to be encoded. This linear combination induces a time-domain aliasing.

The two lapped quarters are then jointly encoded after DCT transformation (type IV). For the next frame, the third and fourth quarters of the preceding frame are then shifted by half a window (50% overlap) to then become the first and second quarters of the current frame. After lapping, a second linear combination of the same pairs of samples as in the preceding frame is sent, but with different weights.

In the decoder, after inverse DCT transformation we obtain the decoded version of these lapped signals. Two consecutive frames contain the result of two different overlaps of the same quarters, meaning that for each pair of samples we have the result of two linear combinations with different but known weights: a system of equations is thus solved to obtain the decoded version of the input signal, and the time-domain aliasing can thus be eliminated by the use of two consecutive decoded frames.

Solving the abovementioned equation systems can generally be done implicitly by undoing the folding, multiplying by a judiciously chosen synthesis window, then overlap-adding the common parts. This overlap-add also ensures a smooth transition (without discontinuities due to quantization errors) between two consecutive decoded frames, effectively acting as a cross-fade. When the window for the first quarter or the fourth quarter is at zero for each sample, we have an MDCT transformation without time-domain aliasing in that portion of the window. In such case, a smooth transition is not provided by the MDCT transformation and must be done by other means, for example an external cross-fade.

It should be noted that variant implementations of the MDCT transformation exist, in particular concerning the definition of the DCT transform, the manner of folding the block to be transformed (for example, one can reverse the signs applied to the folded quarters on the left and right, or fold the second and third quarters respectively over the first and fourth quarters), etc. These variants do not change the principle of MDCT analysis-synthesis with reduction of the sample block by windowing, time-domain aliasing, then transformation and finally windowing, folding, and overlap-add.

To avoid artifacts at the transitions between CELP coding and MDCT coding, international patent application WO2012/085451, which is hereby incorporated by reference in the present application, provides a method for coding a transition frame. The transition frame is defined as a current frame encoded by transform which is the successor of a preceding frame encoded by predictive coding. According to said novel method, a portion of the transition frame, for example a sub-frame of 5 ms in the case of core CELP coding at 12.8 kHz, and two additional CELP frames of 4 ms each in the case of core CELP coding at 16 kHz, are encoded by a predictive coding that is more limited than the predictive coding of the preceding frame.

Limited predictive coding consists of using the stable parameters of the preceding frame encoded by predictive coding, for example the coefficients of the linear prediction filter, and coding only a few minimal parameters for the additional sub-frame in the transition frame.

As the preceding frame was not encoded with transform coding, it is impossible to undo the time-domain aliasing in the first part of the frame. The patent application WO2012/085451 cited above further proposes modifying the first half of the MDCT window to have no time-domain aliasing in the normally-folded first quarter. It also proposes integrating a portion of the overlap-add (also called "cross-fade") between the decoded CELP frame and the decoded MDCT frame while changing the coefficients of the analysis/synthesis window. Referring to FIG. 4*e* of said patent application, the broken lines (alternating dots and dashes) correspond to the folding lines of the MDCT encoding (top figure) and to the unfolding lines of the MDCT decoding (bottom figure). In the upper figure, bold lines separate the frames of new samples entering the encoder. The encoding of a new MDCT frame can begin when a thusly defined frame of new input samples is completely available. It is important to note that these bold lines in the encoder do not correspond to the current frame but to the block of new incoming samples for each frame: the current frame is actually delayed by 5 ms, corresponding to a lookahead. In the bottom figure, bold lines separate the decoded frames at the decoder output.

In the encoder, the transition window is zero until the folding point. Thus the coefficients of the left side of the folded window will be identical to those of the unfolded window. The portion between the folding point and the end of the CELP transition sub-frame (TR) corresponds to a sine (half-) window. In the decoder, after unfolding, the same window is applied to the signal. In the segment between the folding point and the beginning of the MDCT frame, the coefficients of the window correspond to a window of type sine. To achieve the overlap-add between the decoded CELP sub-frame and the signal from the MDCT, it is sufficient to apply a window of type cost to the overlap portion of the CELP sub-frame and to add the latter with the MDCT frame. The method provides a perfect reconstruction.

However, encoded audio signal frames may be lost in the channel between the encoder and the decoder.

Existing frame-loss correction techniques are often highly dependent on the type of coding used.

In the case of speech coding based on predictive technology, such as CELP for example, frame loss correction is often tied to the speech model. For example, the ITU-T G.722.2 standard, in its version of July 2003, proposes replacing a lost packet by extending the long-term prediction gain while attenuating it, and extending the frequency spectral lines (ISF for "Immittance Spectral Frequencies") representing the A(z) coefficients of the LPC filter, while causing them to trend towards their respective averages. The pitch period is also repeated. The fixed codebook contribution is filled with random values. Application of such methods to transform or PCM decoders requires CELP analysis in the decoder, which would introduce significant added complexity. Note also that more advanced methods of frame loss correction in CELP decoding are described in the ITU-T G.718 standard, for rates of 8 and 12 kbit/s as well as for decoding rates that are interoperable with AMR-WB.

Another solution is presented in the ITU-T G.711 standard, which describes a transform coder for which the frame loss correction algorithm, discussed in the "Appendix I" section, consists of finding a pitch period in the already decoded signal and repeating it by applying an overlap-add between the already decoded signal and the repeated signal. This overlap-add erases audio artifacts but requires additional time in the decoder (corresponding to the duration of the overlap-add) in order to implement it.

In the case of transform coding, a common technique for correcting frame loss is to repeat the last frame received. Such a technique is implemented in various standardized encoders/decoders (G.719, G.722.1, and G.722.1C in particular). For example, in the case of the G.722.1 decoder, an MLT transform ("Modulated Lapped Transform"), equivalent to an MDCT transform with an overlap of 50% and a sine window, ensures a sufficiently slow transition between the last lost frame and the repeated frame to erase artifacts related to simple repetition of the frame.

There is little cost to such a technique, but its main deficiency is the inconsistency between the signal just before the frame loss and the repeated signal. This results in a phase discontinuity that can introduce significant audio artifacts if the duration of the overlap between the two frames is small, as is the case where the windows used for the MLT transform are low-delay windows.

In existing techniques, when a frame is missing a replacement frame is generated in the decoder using an appropriate PLC (packet loss concealment) algorithm. Note that generally a packet can contain multiple frames, so the term PLC can be ambiguous; it is used here to indicate the correction of the current lost frame. For example, after a CELP frame is correctly received and decoded, if the following frame is lost, a replacement frame based on a PLC appropriate for CELP coding is used, making use of the memory of the CELP coder. After an MDCT frame is correctly received and decoded, if the next frame is lost, a replacement frame based on a PLC appropriate for MDCT coding is generated.

In the context of the transition between CELP and MDCT frames, and considering that the transition frame is composed of a CELP sub-frame (which is at same sampling frequency as the directly preceding CELP frame) and a MDCT frame comprising a modified MDCT window canceling out the "left" folding, there are situations where the existing techniques do not provide a solution.

In a first situation, a previous CELP frame has been correctly received and decoded, a current transition frame has been lost, and the next frame is an MDCT frame. In this case, after reception of the CELP frame, the PLC algorithm does not know that the lost frame is a transition frame and therefore generates a replacement CELP frame. Thus, as previously explained, the first folded portion of the next MDCT frame cannot be compensated for and the time between the two types of encoder cannot be filled with the CELP sub-frame contained in the transition frame (which was lost with the transition frame). No known solution addresses this situation.

In a second situation, a previous CELP frame at 12.8 kHz has been correctly received and decoded, a current CELP frame at 16 kHz has been lost, and the next frame is a transition frame. The PLC algorithm then generates a CELP frame at the frequency of the last frame received correctly, which is 12.8 kHz, and the transition CELP sub-frame (partially encoded using CELP parameters of the lost CELP frame at 16 kHz) cannot be decoded.

SUMMARY

The present disclosure aims to improve this situation.

To this end, a first aspect of the disclosure relates to a method for decoding a digital signal encoded using predictive coding and transform coding, comprising the following steps:

- predictive decoding of a preceding frame of the digital signal, encoded by a set of predictive coding parameters;
- detecting the loss of a current frame of the encoded digital signal;
- generating, by prediction, from at least one predictive coding parameter encoding the preceding frame, a replacement frame for the current frame;
- generating, by prediction, from at least one predictive coding parameter encoding the preceding frame, an additional segment of digital signal;
- temporarily storing this additional segment of digital signal.

Thus, an additional segment of digital signal is available whenever a replacement CELP frame is generated. The predictive decoding of the preceding frame covers the predictive decoding of a correctly received CELP frame or the generation of a replacement CELP frame by a PLC algorithm suitable for CELP.

This additional segment makes a transition possible between CELP coding and transform coding, even in the case of frame loss.

Indeed, in the first situation described above, the transition to the next MDCT frame can be provided by the additional segment. As is described below, the additional segment can be added to the next MDCT frame to compensate for the first folded portion of this MDCT frame by means of a cross-fade in the region containing the time-domain aliasing that has not been undone.

In the second situation described above, decoding of the transition frame is made possible by use of the additional segment. If it is not possible to decode the transition CELP sub-frame (unavailability of CELP parameters of the preceding frame coded at 16 kHz), it is possible to replace it with the additional segment as described below.

Moreover, the calculations related to frame loss management and the transition are spread over time. The additional segment is generated and stored for each replacement CELP frame generated. The transition segment is therefore generated when a frame loss is detected, without waiting for subsequent detection of a transition. The transition is thus anticipated with each frame loss, which avoids having to manage a "complexity spike" at the time when a correct new frame is received and decoded.

In one embodiment, the method further comprises the steps of:

- receiving a next frame of encoded digital signal comprising at least one segment encoded by transform; and
- decoding the next frame, comprising a sub-step of overlap-adding the additional segment of digital signal and the segment encoded by transform. The overlap-add sub-step makes it possible to cross-fade the output signal. Such a cross-fade reduces the appearance of sound artifacts (such as "ringing noise") and ensures consistency in the signal energy.

In another embodiment, the next frame is entirely encoded by transform coding and the lost current frame is a transition frame between the preceding frame encoded by predictive coding and the next frame encoded by transform coding.

Alternatively, the preceding frame is encoded by predictive coding via a core predictive coder operating at a first frequency. In this variant, the next frame is a transition frame comprising at least one sub-frame encoded by predictive coding via a core predictive coder operating at a second frequency that is different from the first frequency. For this purpose, the next transition frame may comprise a bit indicating the frequency of the core predictive coding used.

Thus, the type of CELP coding (12.8 or 16 kHz) used in the transition CELP sub-frame can be indicated in the bit stream of the transition frame. The disclosure thus adds a systematic indication (one bit) to a transition frame, to enable detection of a frequency difference in the CELP encoding/decoding between the transition CELP sub-frame and the preceding CELP frame.

In another embodiment, the overlap-add is given by applying the following formula which employs linear weighting:

$$S(i) = B(i) \cdot \frac{i}{(L/r)} + \left(1 - \frac{i}{(L/r)}\right) \cdot T(i)$$

where:

- r is a coefficient representing the length of the generated additional segment;
- i is a time of a sample of the next frame, between 0 and L/r;
- L is the length of the next frame;
- S(i) is the amplitude of the next frame after addition, for sample i;
- B(i) is the amplitude of the segment decoded by transform, for sample i;
- T(i) is the amplitude of the additional segment of digital signal, for sample i.

The overlap-add can therefore be done using linear combinations and operations that are simple to implement. The time required for decoding is thus reduced while placing less load on the processor or processors used for these calculations. Alternatively, other forms of cross-fade can be implemented without changing the principle of the disclosure.

In one embodiment, the step of generating, by prediction, the replacement frame further comprising an updating of the internal memories of the decoder, the step of generating, by prediction, an additional segment of digital signal may comprise the following sub-steps:

copying, to a temporary memory, from memories of the decoder that were updated during the generation by prediction of the replacement frame;

generating the additional segment of digital signal, using the temporary memory.

Thus, the internal memories of the decoder are not updated for the generation of the additional segment. As a result, the generation of the additional signal segment does not impact the decoding of the next frame, in the case where the next frame is a CELP frame.

Indeed, if the next frame is a CELP frame, the internal memories of the decoder must correspond to the states of the decoder after the replacement frame.

In one embodiment, the step of generating, by prediction, an additional segment of digital signal comprises the following sub-steps:

generating, by prediction, an additional frame from at least one predictive coding parameter encoding the preceding frame;

extracting a segment of the additional frame.

In this embodiment, the additional segment of digital signal corresponds to the first half of the additional frame. The efficiency of the method is thus further improved because the temporary calculation data used for generating the replacement CELP frame are directly available for generation of the additional CELP frame. Typically, the registers and caches in which the temporary calculation data are stored do not have to be updated, enabling direct reuse of these data for generation of the additional CELP frame.

A second aspect of the disclosure provides a computer program comprising instructions for implementing the method according to the first aspect of the disclosure, when these instructions are executed by a processor.

A third aspect of the disclosure provides a decoder for a digital signal encoded using predictive coding and transform coding, comprising:

a detection unit for detecting the loss of a current frame of the digital signal;

a predictive decoder comprising a processor arranged to carry out the following operations:

predictive decoding of a preceding frame of the digital signal, coded by a set of predictive coding parameters;

generating, by prediction, from at least one predictive coding parameter encoding the preceding frame, a replacement frame for the current frame;

generating, by prediction, from at least one predictive coding parameter encoding the preceding frame, an additional segment of digital signal;

temporarily storing this additional segment of digital signal in temporary memory.

In one embodiment, the decoder according to the third aspect of the disclosure further comprises a transform decoder comprising a processor arranged to carry out the following operations:

receiving a next frame of encoded digital signal comprising at least one segment encoded by transform; and decoding the next frame, comprising a sub-step of overlap-add between the additional segment of digital signal and the segment encoded by transform.

In the encoder, the disclosure may comprise the insertion into the transition frame of a bit providing information about the CELP core used for coding the transition sub-frame.

BRIEF DESCRIPTION OF THE DRAWINGS

Other features and advantages will become apparent upon examining the following detailed description and the appended drawings in which.

DETAILED DESCRIPTION

Figure 1:
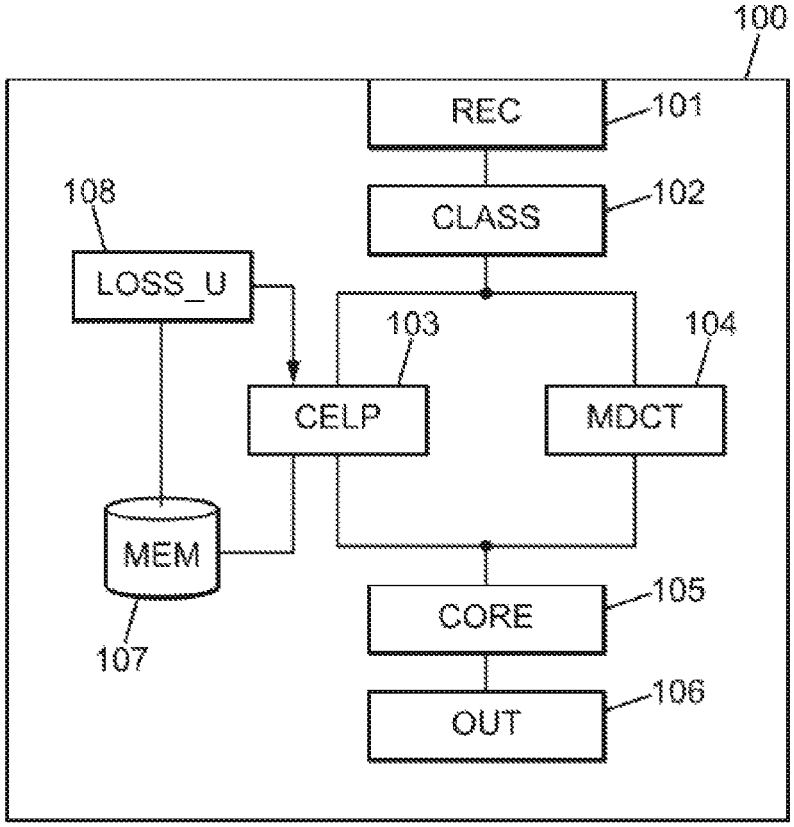
FIG. 1 illustrates an audio decoder according to an embodiment.

FIG. 1 illustrates an audio decoder 100 according to an embodiment.

No audio encoder structure is shown. However, the encoded digital audio signal received by the decoder may come from an encoder adapted to encode an audio signal in the form of CELP frames, MDCT frames, and CELP/MDCT transition frames, such as the encoder described in patent application WO2012/085451. For this purpose, a transition frame, coded by transform, may further comprise a segment (a sub-frame for example) coded by predictive coding. The encoder may further add a bit to the transition frame in order to identify the frequency of the CELP core used. The CELP coding example is provided to illustrate a description applicable to any type of predictive coding. Similarly, the MDCT coding example is provided to illustrate a description applicable to any type of transform coding.

The decoder 100 comprises a unit 101 for receiving an encoded digital audio signal. The digital signal is encoded in the form of CELP frames, MDCT frames, and CELP/MDCT transition frames. In variants of the embodiment, modes other than CELP and MDCT are possible, and other mode combinations are possible, without changing the principle of the disclosure. Furthermore, the CELP coding can be replaced by another type of predictive coding, and the MDCT coding can be replaced by another type of transform coding.

The decoder 100 further comprises a classification unit 102 adapted to determine—in general simply by reading the bit stream and interpreting the indications received from the encoder—whether a current frame is a CELP frame, an MDCT frame, or a transition frame. Depending on the classification of the current frame, the frame may be transmitted to a CELP decoder 103 or MDCT decoder 104 (or both in the case of a transition frame, the CELP transition sub-frame being transmitted to a decoding unit 105 described below). In addition, when the current frame is a properly received transition frame and the CELP coding can occur in at least two frequencies (12.8 and 16 kHz), the classification unit 102 can determine the type of CELP coding used in the additional CELP sub-frame—this coding type being indicated in the bit rate output from the encoder.

Figure 2:
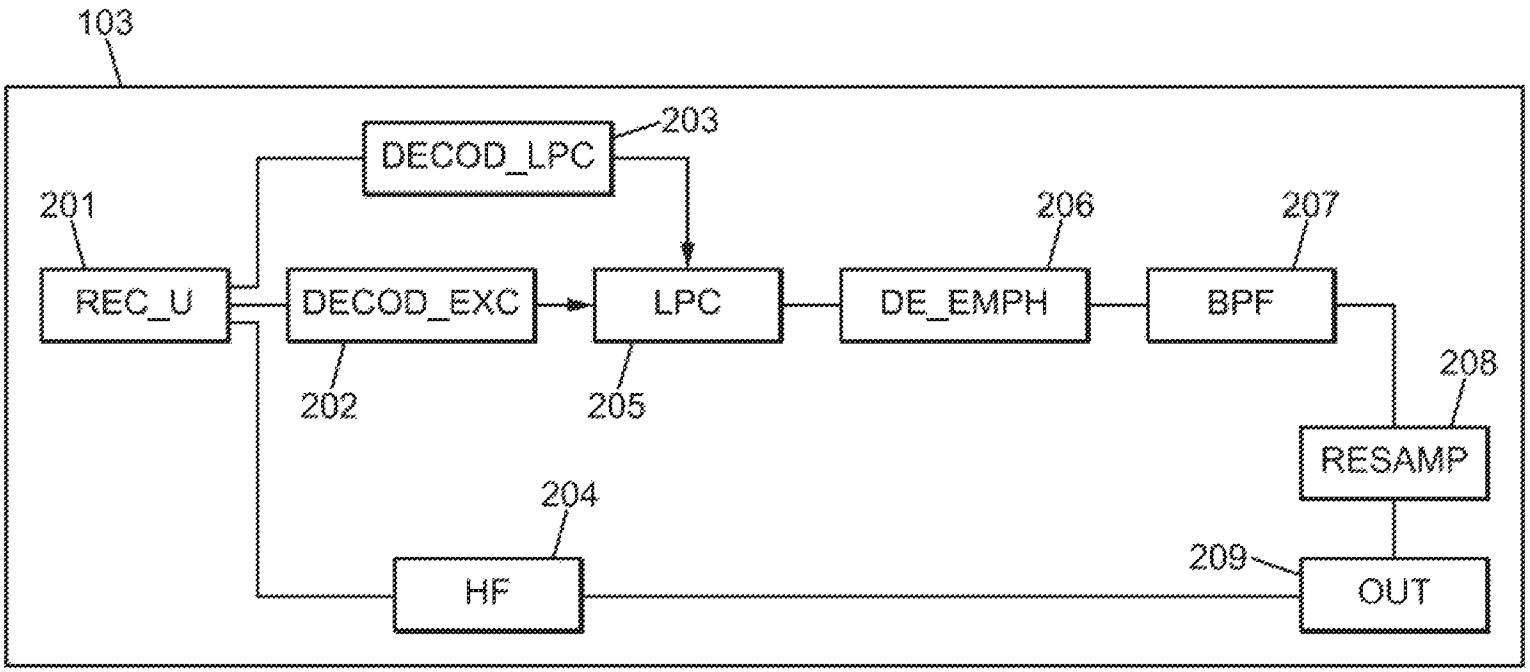
FIG. 2 illustrates a CELP decoder of an audio decoder, such as the audio decoder of FIG. 1, according to an embodiment.

An example of a CELP decoder structure 103 is shown with reference to FIG. 2.

A receiving unit 201, which may include a demultiplexing function, is adapted to receive CELP coding parameters for the current frame. These parameters may include excitation parameters (for example gain vectors, fixed codebook vector, adaptive codebook vector) transmitted to a decoding unit 202 able to generate an excitation. In addition, CELP coding parameters may include LPC coefficients represented as LSF or ISF for example. The LPC coefficients are decoded by a decoding unit 203 adapted to provide the LPC coefficients to an LPC synthesis filter 205.

The synthesis filter 205, excited by the excitation generated by unit 202, synthesizes a digital signal frame (or generally a sub-frame) transmitted to a de-emphasis filter 206 (function of the form $1/(1-\alpha z^{-1})$ where for example $\alpha=0.68$). At the output from the de-emphasis filter, the CELP decoder 103 may include low frequency post-processing (bass-post filter 207) similar to that described in the ITU-T G.718 standard. The CELP decoder 103 further comprises resampling 208 of the synthesized signal at the output frequency (output frequency of the MDCT decoder 104), and an output interface 209. In variants of the disclosure, additional post-processing of the CELP synthesis may be implemented before or after resampling.

In addition, when the digital signal is divided into high and low frequency bands before coding, the CELP decoder 103 may comprise a high frequency decoding unit 204, the low frequency signal being decoded by the units 202 to 208 described above. The CELP synthesis may involve updating internal states of the CELP encoder (or updating internal memories), such as:

states used for decoding the excitation;
the memory of the synthesis filter 205;
the memory of the de-emphasis filter 206;
post-processing memories 207;
memories of the resampling unit 208.

Referring to FIG. 1, the decoder further comprises a frame loss management unit 108 and a temporary memory 107.

In order to decode a transition frame, the decoder 100 further comprises a decoding unit 105 adapted to receive the CELP transition sub-frame and the transform-decoded transition frame output from the MDCT decoder 104, in order to decode the transition frame by overlap-add of the received signals. The decoder 100 may further comprise an output interface 106.

Figure 3:
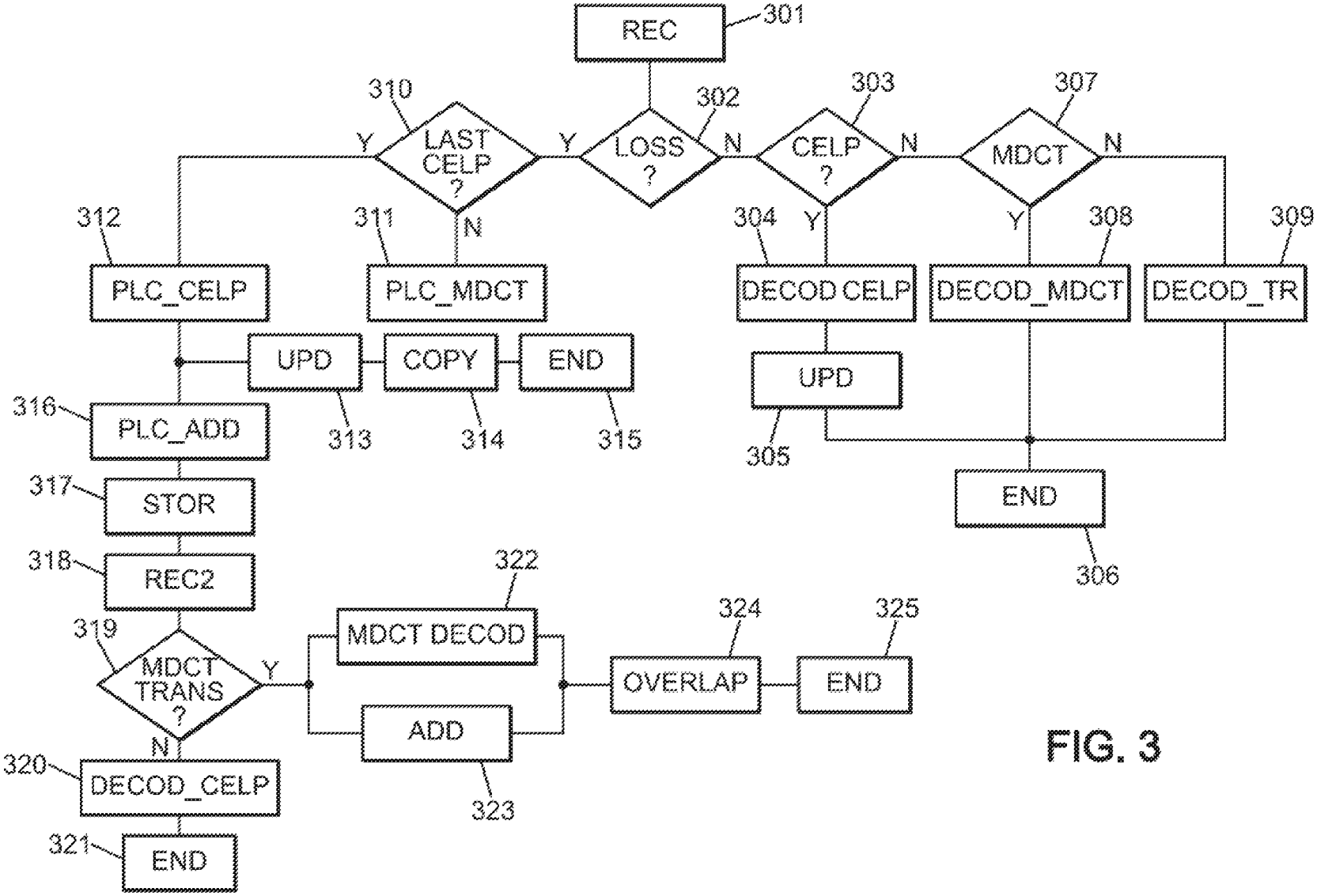
FIG. 3 is a diagram illustrating the steps of a decoding method implemented by the audio decoder of FIG. 1, according to an embodiment.

The operation of the decoder 100 according to an embodiment will be better understood by referring to FIG. 3 which is a diagram showing the steps of a method according to an embodiment.

In step 301, a current frame of encoded digital audio signal may or may not be received by the receiving unit 101 from an encoder. The preceding frame of audio signal is considered to be a frame properly received and decoded or a replacement frame.

In step 302, it is detected whether the encoded current frame is missing or if it was received by the receiving unit 101.

If the encoded current frame has been actually received, the classification unit 102 determines in step 303 whether the encoded current frame is a CELP frame.

If the encoded current frame is a CELP frame, the method comprises a step 304 of decoding and resampling the encoded CELP frame, by the CELP decoder 103. The aforementioned internal memories of the CELP decoder 103 can then be updated in step 305. In step 306, the decoded and resampled signal is outputted from the decoder 100. The excitation parameters of the current frame and the LPC coefficients may be stored in memory 107.

When the encoded current frame is not a CELP frame, the current frame comprises at least one segment encoded by transform coding (MDCT frame or transition frame). Step 307 then checks whether the encoded current frame is an MDCT frame. If such is the case, the current frame is decoded in step 308 by the MDCT decoder 104, and the decoded signal is output from the decoder 100 in step 306.

However, if the current frame is not an MDCT frame, then it is a transition frame which is decoded in step 309 by decoding both the CELP transition sub-frame and the current frame encoded by MDCT transform, and by overlap-adding the signals from the CELP decoder and MDCT decoder in order to obtain a digital signal as output from the decoder 100 in step 306.

When the current sub-frame has been lost, in step 310 it is determined whether the received and decoded preceding frame was a CELP frame. If such is not the case, a PLC algorithm adapted for MDCT, implemented in the frame loss management unit 108, generates an MDCT replacement frame decoded by the MDCT decoder 104 in order to obtain a digital output signal, in step 311.

If the last correctly received frame was a CELP frame, a PLC algorithm adapted for CELP is implemented by the frame loss management unit 108 and the CELP decoder 103 in order to generate a replacement CELP frame, in step 312.

The PLC algorithm may include the following steps:

estimation by interpolation of the LSF parameters and the LPC filter based on the LSF parameters of the preceding frame, while updating, in step 313, the LSF predictive quantifiers stored in memory (which may be of type AR or MA for example); an example implementation of the estimation of LPC parameters in case of frame loss for the case of ISF parameters is given in paragraphs 7.11.1.2 "ISF estimation and interpolation" and 7.11.1.7 "Spectral envelope concealment, synthesis, and updates" of the ITU-T G.718 standard. Alternatively, the estimation described in paragraph 1.5.2.3.3 of the ITU-T G.722.2 standard, Appendix I, may also be used in the case of MA type quantification;

estimation of excitation based on the adaptive gain and fixed gain of the preceding frame, updating these values, in step 313, for the next frame. An example estimation of excitation is described in paragraphs 7.11.1.3 "Extrapolation of future pitch," 7.11.1.4 "Construction of the periodic part of the excitation," 7.11.1.15 "Glottal pulse resynchronization in low-delay", 7.11.1.6 "Construction of the random part of excitation." The fixed codebook vector is typically replaced in each sub-frame by a random signal while the adaptive codebook uses an extrapolated pitch and the codebook gains from the preceding frame have typically been attenuated according to the class of signal in the last frame received. Alternately, the estimation of excitation described in the ITU-T G.722.2 standard, Appendix I, may also be used;

synthesizing the signal based on the excitation and the updated synthesis filter 205 and using the synthesis memory for the preceding frame, updating the synthesis memory for the preceding frame in step 313;

de-emphasis of the synthesized signal by using the de-emphasis unit 206, and by updating the memory of the de-emphasis unit 206 in step 313;

optionally, post-processing the synthesized signal 207 while updating the post-processing memory in step 313—note that post-processing may be disabled during frame loss correction because the information it uses is unreliable as it is simply extrapolated, in which case the post-processing memories should still be updated to allow normal operation with the next frame received;

resampling of the synthesized signal at the output frequency by the resampling unit 208, while updating the filter memory 208 in step 313.

Updating the internal memories allows seamless decoding of a possible next frame encoded by CELP prediction. Note that in the ITU-T G.718 standard, techniques for recovery and control of synthesis energy are also used (for example in clauses 7.11.1.8 and 7.11.1.8.1) when decoding a frame received after a frame loss correction. This aspect is not considered here as it lies outside the scope of the disclosure.

In step 314, the memories updated in this manner can be copied to the temporary memory 107. The decoded replacement CELP frame is output from the decoder in step 315.

In step 316, the method according to an embodiment provides for the generation, by prediction, of an additional segment of digital signal, making use of a PLC algorithm adapted for CELP. Step 316 may comprise the following sub-steps:

estimation by interpolation of the LSF parameters and the LPC filter based on the LSF parameters of the preceding CELP frame, without updating the LSF quantifiers stored in memory. The estimation by interpolation may be implemented using the same method as for the estimation by interpolation for the replacement frame, described above (without updating the LSF quantifiers stored in memory);

estimation of excitation based on the adaptive gain and fixed gain of the preceding CELP frame, without updating these values for the next frame. The excitation may be determined using the same method as for the determination of excitation for the replacement frame (without updating the adaptive gain and fixed gain values);

synthesizing a signal segment (a half-frame or sub-frame for example) based on the excitation and the recalculated synthesis filter 205 and using the synthesis memory for the preceding frame;

de-emphasis of the synthesized signal by using the de-emphasis unit 206;

optionally, post-processing the synthesized signal by using the post-processing memory 207;

resampling of the synthesized signal at the output frequency by the resampling unit 208, using the resampling memories 208.

It is important to note that for each of these steps, an embodiment provides for storing in temporary variables the CELP decoding states that are modified in each step, before carrying out these steps, so that the predetermined states can be restored to their stored values after generation of the temporary segment.

The generated additional signal segment is stored in memory 107 in step 317.

In step 318, a next frame of digital signal is received by the receiving unit 101. Step 319 checks whether the next frame is an MDCT frame or transition frame.

If such is not the case, then the next frame is a CELP frame and it is decoded by the CELP decoder 103 in step 320. The additional segment synthesized in step 316 is not used and can be deleted from memory 107.

If the next frame is an MDCT frame or transition frame, it is decoded by the MDCT decoder 104 in step 322. In parallel, the additional digital signal segment stored in memory 107 is retrieved in step 323 by the management unit 108 and is sent to the decoding unit 105.

If the next frame is an MDCT frame, the obtained additional signal segment allows unit 103 to carry out an overlap-add in order to correctly decode the first part of the next MDCT frame, in step 324. For example, when the additional segment is half a sub-frame, a linear gain between 0 and 1 may be applied during the overlap-add to the first half of the MDCT frame and a linear gain between 1 and 0 is applied to the additional signal segment. Without this additional signal segment, the MDCT decoding may result in discontinuities due to quantization errors.

When the next frame is a transition frame, we distinguish two cases as seen below. Remember that the decoding of the transition frame is based not only on the classification of the current frame as a "transition frame", but also on an indication of the type of CELP coding (12.8 or 16 kHz) when multiple CELP coding rates are possible. Thus:

if the preceding CELP frame was encoded by a core coder at a first frequency (12.8 kHz for example) and the transition CELP sub-frame was encoded by a core coder at a second frequency (16 kHz for example), then the transition sub-frame cannot be decoded, and the additional signal segment then allows the decoding unit 105 to perform the overlap-add with the signal resulting from the MDCT decoding of step 322. For example, when the additional segment is half a sub-frame, a linear gain between 0 and 1 can be applied during the overlap-add to the first half of the MDCT frame and a linear gain between 1 and 0 is applied to the additional signal segment;

if the preceding CELP frame and the transition CELP sub-frame were encoded by a core coder at the same frequency, then the transition CELP sub-frame can be decoded and used by the decoding unit 105 for the overlap-add with the digital signal coming from the MDCT decoder 104 that decoded the transition frame.

The overlap-add of the additional signal segment and the decoded MDCT frame can be given by the following formula:

$$S(i) = B(i) \cdot \frac{i}{(L/r)} + \left(1 - \frac{i}{(L/r)}\right) \cdot T(i)$$

where:

r is a coefficient representing the length of the generated additional segment, the length being equal to L/r. No restrictions are placed on the value r, which will be selected to allow sufficient overlap between the additional signal segment and the decoded transition MDCT frame. For example, r may be equal to 2;

i is a time corresponding to a sample of the next frame, between 0 and L/r;

L is the length of the next frame (for example 20 ms);

S(i) is the amplitude of the next frame after addition, for sample i;

B(i) is the amplitude of the segment decoded by transform, for sample i;

T(i) is the amplitude of the additional segment of digital signal, for sample i.

The digital signal obtained after the overlap-add is output from the decoder in step 325.

When there is loss of a current frame following a preceding CELP frame, the embodiment thus provides for the generation of an additional segment in addition to a replacement frame. In some cases, particularly if the next frame is a CELP frame, said additional segment is not used. However, the calculation does not introduce any additional complexity, as the coding parameters of the preceding frame are reused. In contrast, when the next frame is an MDCT frame or a transition frame with a CELP sub-frame at a different core frequency than the core frequency used for encoding the preceding CELP frame, the generated and stored additional signal segment allows decoding the next frame, which is not possible in the solutions of the prior art.

Figure 4:
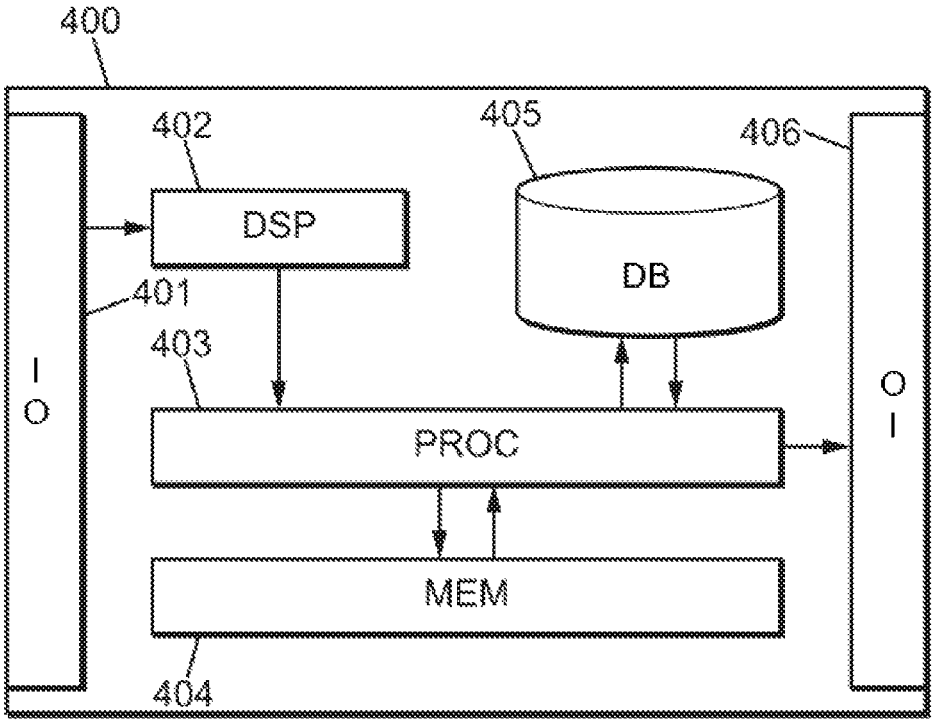
FIG. 4 illustrates a computing device according to an embodiment.

FIG. 4 represents an exemplary computing device 400 that can be integrated into the CELP coder 103 and into the MDCT coder 104.

The device 400 comprises a random access memory 404 and a processor 403 for storing instructions enabling the implementation of steps of the method described above (implemented by the CELP coder 103 or the MDCT coder 104). The device also comprises mass storage 405 for storing data to be retained after application of the method. The device 400 further comprises an input interface 401 and an output interface 406, respectively intended for receiving frames of the digital signal and for transmitting the decoded signal frames.

The device 400 may further comprise a digital signal processor (DSP) 402.

The DSP 402 receives the digital signal frames in order to format, demodulate, and amplify these frames in a known manner.

The present disclosure is not limited to the embodiments described above as examples; it extends to other variants.

Above we have described an embodiment in which the decoder is a separate entity. Of course, such a decoder can be embedded in any type of larger device such as a mobile phone, a computer, etc.

In addition, we have described an embodiment proposing a specific architecture for the decoder. These architectures are only provided for illustrative purposes. A different arrangement of the components and a different distribution of the tasks assigned to each of these components is also possible.

The invention claimed is:

1. A method for decoding a digital audio signal encoded using predictive coding and transform coding, wherein the method comprises the following operations:

predictive decoding of a preceding frame of the digital audio signal, encoded by a set of predictive coding parameters; and upon detecting the loss of a current frame of the encoded digital audio signal, before receiving a next frame following the current frame, and thus regardless of whether the next frame is encoded using predictive coding or encoded using transform coding or is a transition frame:

generating, by prediction, from at least one predictive coding parameter encoding the preceding frame, a replacement frame for the current frame;

generating, by prediction, from at least one predictive coding parameter encoding the preceding frame, an additional segment of digital audio signal; and temporarily storing said additional segment of digital audio signal; and upon receiving of the next frame, if the next frame is encoded using transform coding or is a transition frame from predictive coding to transform coding, the method further comprises decoding said next frame using said additional segment of digital audio signal, the next frame of encoded digital audio signal comprising at least one segment encoded by transform and the preceding frame is encoded by predictive coding via a core predictive coder operating at a first frequency, and wherein the next frame is a transition frame comprising at least one sub-frame encoded by predictive coding via a core predictive coder operating at a second frequency that is different from the first frequency, the next frame comprising a bit indicating the frequency of the core predictive coding used.

2. The method according to claim 1, wherein decoding the next frame comprises a sub-step of overlap-adding the additional segment of digital audio signal and said segment encoded by transform.

3. The method according to claim 1, wherein the step of generating, by prediction, the replacement frame further comprises an updating of the internal memories of the decoder, and wherein the step of generating, by prediction, an additional segment of digital audio signal comprises the following sub-operations:

copying to a temporary memory, from memories of the decoder that were updated during the step of generating, by prediction, the replacement frame;

generating the additional segment of digital audio signal, using the temporary memory.

4. The method according to claim 1, wherein the step of generating, by prediction, an additional segment of digital audio signal comprises the following sub-operations:

generating, by prediction, an additional frame from at least one predictive coding parameter encoding the preceding frame;

extracting a segment of the additional frame; and wherein the additional segment of digital audio signal corresponds to the first half of the additional frame.

5. A non-transitory computer readable storage medium, with a program stored thereon, said program comprising instructions for implementing the method according to claim 1, when these instructions are executed by a processor.

6. A decoder for a digital audio signal encoded using predictive coding and transform coding, wherein the decoder comprises:

a detection unit for detecting the loss of a current frame of the digital audio signal;

a predictive decoder comprising a processor arranged to carry out the following operations, upon detection of the loss of the current frame and before receiving of a next frame following the current frame, and thus regardless of whether the next frame is encoded using predictive coding or encoded using transform coding or is a transition frame:

predictive decoding of a preceding frame of the digital audio signal, coded by a set of predictive coding parameters;

generating, by prediction, from at least one predictive coding parameter encoding the preceding frame, a replacement frame for the current frame;

generating, by prediction, from at least one predictive coding parameter encoding the preceding frame, an additional segment of digital audio signal; and temporarily storing said additional segment of digital audio signal in temporary memory;

upon receiving of the next frame, if the next frame is encoded using transform coding or is a transition frame from predictive coding to transform coding, the predictive decoder further comprises a transform decoder comprising a processor arranged to decode said next frame using said additional segment of digital audio signal, the next frame of encoded digital audio signal comprising at least one segment encoded by transform and the preceding frame is encoded by predictive coding via a core predictive coder operating at a first frequency, and wherein the next frame is a transition frame comprising at least one sub-frame encoded by predictive coding via a core predictive coder operating at a second frequency that is different from the first frequency, the next frame comprising a bit indicating the frequency of the core predictive coding used.

7. The decoder according to claim 6, wherein said decoder further comprises a decoding unit comprising a processor arranged to perform an overlap-add between the additional segment of digital audio signal and said segment coded by transform.

* * * * *